US005735143A

United States Patent [19]

Tanaka

[11] Patent Number: 5,735,143

[45] Date of Patent: Apr. 7, 1998

[54] DIET EARRING OF TRAGUS ENGAGEMENT TYPE

[76] Inventor: Ryuzo Tanaka, 253-10, Nakamurahara, Odawara-shi, Kanagawa-ken, Japan

[21] Appl. No.: 710,644

[22] Filed: Sep. 18, 1996

[30] Foreign Application Priority Data

Nov. 6, 1995 [JP] Japan ..... 7-013148

[51] Int. Cl.[6] ..... A44C 7/00

[52] U.S. Cl. ..... 63/14.3; 63/14.5; 63/14.8; 606/204

[58] Field of Search ..... 63/12, 14.1, 14.3, 63/14.8, 14.6, 14.7, 14.5; 606/204, 188

[56] References Cited

U.S. PATENT DOCUMENTS

| | | | |
|---|---|---|---|
| 2,510,511 | 6/1950 | Mittendorf | 63/14.3 |
| 2,557,200 | 6/1951 | Pujol | 63/14.3 |
| 2,763,999 | 9/1956 | Norman | 63/14.3 |
| 2,795,118 | 6/1957 | Shill | 63/14.3 |
| 2,819,595 | 1/1958 | Northup | 63/14.3 |
| 2,882,702 | 4/1959 | Goldberg et al. | 63/12 X |
| 2,964,927 | 12/1960 | Patterson | 63/14.3 |
| 4,073,296 | 2/1978 | McCall | 606/204 |
| 4,098,277 | 7/1978 | Mendell | 606/204 |
| 4,319,574 | 3/1982 | Sun et al. | 63/12 X |
| 4,796,443 | 1/1989 | Bannister et al. | 63/14.6 X |
| 5,176,009 | 1/1993 | Lang | 63/14.1 |
| 5,366,475 | 11/1994 | Voss et al. | 606/204 |
| 5,584,854 | 12/1996 | Minarik | 606/204 X |
| 5,662,679 | 9/1997 | Voss et al. | 606/204 |

FOREIGN PATENT DOCUMENTS 7123625 8/1995 Japan .

*Primary Examiner*—David M. Purol
*Attorney, Agent, or Firm*—Gifford, Krass, Groh, Sprinkle, Patmore, Anderson & Citkowski, P.C.

[57] ABSTRACT

Disclosed is a diet earring for stimulating acupuncture points located on the human tragus used in a simple procedure to eliminate disadvantages of the conventional needle puncture process. The earring has a pressing member 1 and a retaining member 2 for engaging the outer surface and the opposite surface of the tragus 9, respectively, and a connecting member 3 provided with an appropriate resilient urging spring for connecting the above-mentioned members, thereby the earring being retained on the both surfaces of the tragus with a suitable pressure with the tragus interposed between the pressing and retaining members.

3 Claims, 3 Drawing Sheets

DIET EARRING OF TRAGUS ENGAGEMENT TYPE

BACKGROUND OF THE INVENTION

1. Field of the Invention

The present invention relates to a diet earring of tragus engagement type, and more particularly to an earring attached to a tragus of the human ear capable of stimulating particularly the two acupuncture points called a "thirst point" and a "hunger point" for achieving the "diet" effect. The "tragus" herein referred to is a flattened, somewhat tongue-like projection of the auricle in front of the opening of the external auditory meatus of the human ear. The "acupuncture points" are the points to each of which, conventionally, a needle such as a "circular subcutaneous needle" or an "intradermal needle" is punctured or which is cauterized with such as "moxa" for diagnostic or remedial purposes.

2. Brief Description of the Prior Art

As a method of stimulating the tragus to achieve a diet effect, there has been known a method such as using a "circular subcutaneous needle" or an "intradermal needle", in which such a needle is punctured to a "thirst point" and a "hunger point" which are acupuncture points located at the tragus effective for achieving the diet effect and an adhesive tape is attached to prevent escapement of the needle.

However, in order to retain the needle, the needle is in the state to be subcutaneously punctured, and accordingly there have been various disadvantages as follows:

(1) Puncture of the needle causes pains;

(2) Therefore, not preferable for the person hardly endure such pains or for children;

(3) Replacement of needles is inevitable in every 3 or 4 days in view of the effective life of needles;

(4) Repeated consults for the doctor is necessary because the use of needles requires special acupuncture techniques by the professional person;

(5) The expense necessary merely for replacing needles is even so high that frequent consultations require an extremely high costs;

(6) Even if one desires to conduct personally the therapy, he is likely to remove the needles once being on purpose pricked; and (7) The stabilization of needles using adhesive tape causes uncleanness as the time lapses and there is a danger that the needles are likely to be possibly removed.

SUMMARY OF THE INVENTION

Accordingly, an object of the present invention is to provide a diet earring of the tragus engagement type capable of achieving the diet effect for maintaining human's health merely retained to the human's tragus without using such needles as mentioned above.

A diet earring of tragus engagement type of the invention comprises a pressing member to be attached to an outer surface of a human tragus; a retaining member to engage an opposite surface of the tragus; a connecting member formed of a resilient material for connecting the pressing member and the retaining member so that the earring is retained to the tragus with the pressing member and retaining member; and a plurality of projections provided on at least one surface of either one of the pressing member and the retaining member which is opposed to each other, thereby the tragus being stimulated during the state of the tragus being retained between the pressing member and the retaining member.

In one aspect of the present invention, the plurality of projections are two projections for stimulating a thirst point and a hunger point of the tragus.

In another aspect of the present invention, the connecting member is a spring urged clip or a resilient member; and each of the pressing member and retaining member are a plate-like member formed in a shape selected from the group consisting of an ellipse, a regular circle, a polygon and any other figure.

A further object of the invention is to provide a diet earring for being worn on the human tragus to be retained on the tragus with pressing and retaining members capable of pressing the thirst and hunger points by means of a plurality of projections formed on the surface of the pressing member, and also for suspending the wearer's thirst and hunger to achieve food limiting (diet) effect, because of by pressing the thirst and hunger points to suspend thirsty feeling and appetite, respectively.

DETAILED DESCRIPTION OF THE PREFERRED EMBODIMENTS

The embodiments of the present invention are hereinafter described.

Embodiment 1

Figure 1:
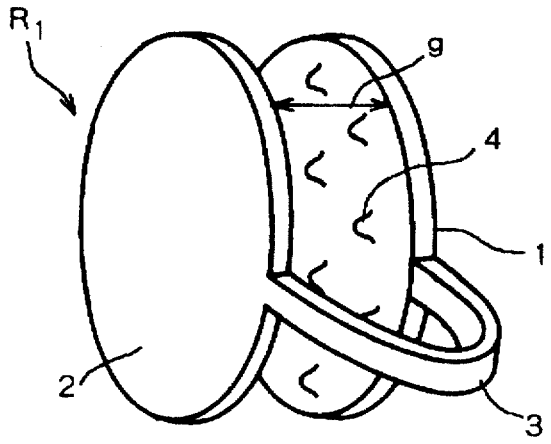
FIG. 1 is a perspective view of a diet earring $R_1$ of tragus engagement type according to a first embodiment of the invention.
Figure 2:
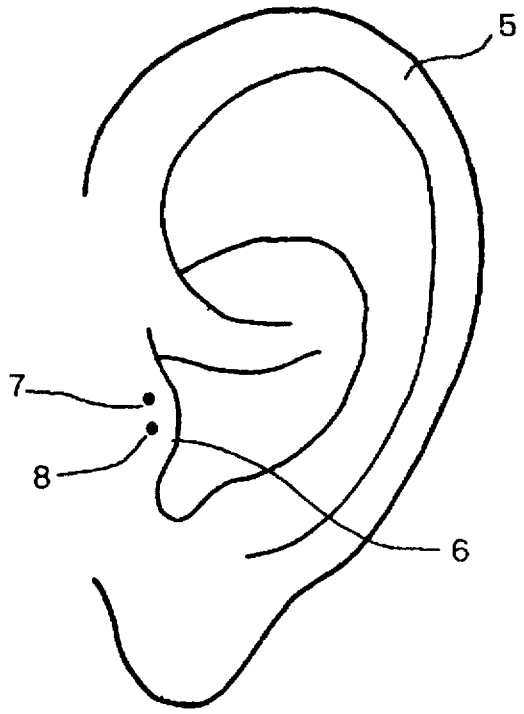
FIG. 2 is a front view illustrating a tragus of the human ear including a "thirst point" and a "hunger point" therein.

In FIGS.1 and 2, a diet earring $R_1$ includes a pressing member 1 formed as a circular disk which is to be attached to the outer surface of a human tragus 6, and a retaining member 2 for abutting the opposite surface of the tragus 6. The pressing and retaining members 1 and 2 are connected together by means of a U-shaped connecting member 3 so as to be opposed to each other with a predetermined distance "g". The member 3 is a spring member formed of a resilient material.

A plurality of round projections 4, such as including ten projections, are formed and substantially uniformly distributed on the surface opposed to the surface of retaining member 2. These projections are distributed so that either two of such projections can press on the thirst and the hunger points, respectively, in the normal wearing condition of the earring $R_1$ onto the tragus 6.

When the earring $R_1$ is retained to tragus 6 with its pressing member 1 and retaining member 2 by way of resilience of connecting member 3, the thirst and hunger points 7 and 8 of tragus 6 should be positioned so as to be pressed by the projections 4. In the point of view, the distance "g" and the magnitude of the spring force of connecting member 3 are provided, wherein the value of the distance "g" is provided to be smaller than the thickness of tragus 6 in the case of the embodiment.

Figure 3:
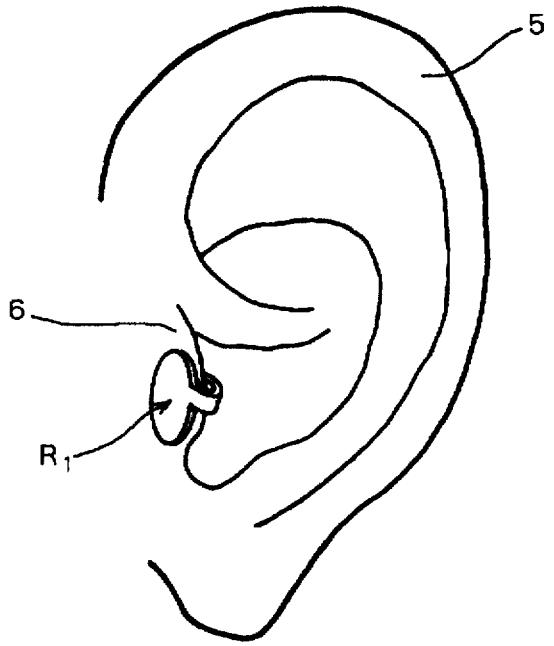
FIG. 3 is a front view of a left ear to which tragus the earring is attached.
Figure 4:
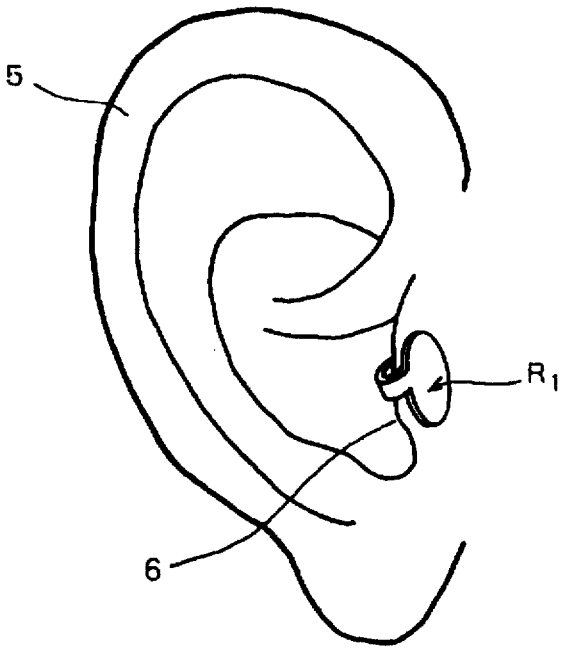
FIG. 4 is a front view of a right ear to which tragus the earring is attached.

The diet earring $R_1$ of such an arrangement is easily attached to tragus 6 so that it is interposed as the pressing member 1 engaging with the outer surface of tragus 6. FIGS. 3 and 4 show the diet earring $R_1$ which is attached to the tragus 6 of the left and right ears 5, respectively.

In the wearing state of tragus 6, the projections 4 stimulate the thirst and hunger points 7 and 8 to effectively suspend the human's appetite for thirsty and hungry.

Embodiment 2

Figure 5:
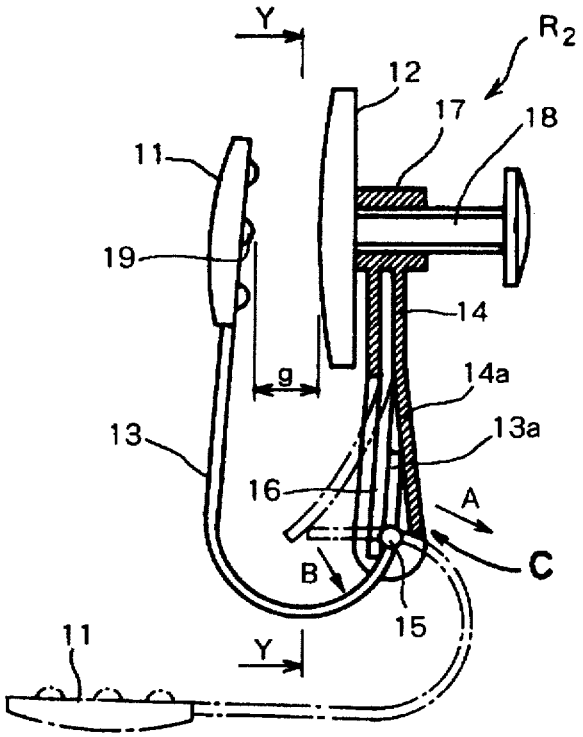
FIG. 5 is a partially sectioned side elevational view of a diet earring $R_2$ according to a second embodiment.
Figure 6:
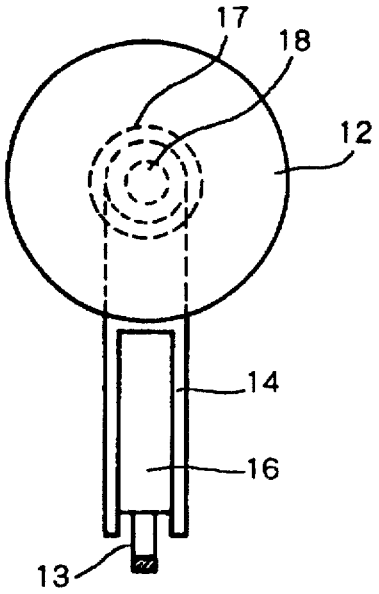
FIG. 6 is a sectional view taken along the line Y—Y of FIG. 5.
Figure 7:
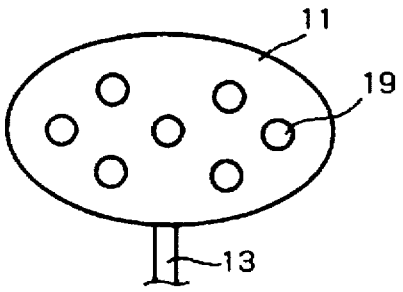
FIG. 7 is a front view of a pressing member.

As illustrated in FIGS. 5 to 7, together with FIG. 2 referred to also, the second embodiment of the diet earring $R_2$ of the invention includes a pressing member 11 formed in an elliptic figure and a retaining member 12 formed in a circular figure. The pressing member 11 and retaining member 12 are connected to each other so as to be pivoted to each other from a closed position to a open position or vice versa by means of a spring urged clip C.

As precisely, the clip C includes a J-shaped arm 13 formed integrally with the pressing member 11 at the end thereof, and also includes an I-shaped frame 14 to which the base end of the arm 13 is joined through a pin hinge 15, but the free end 13*a* of arm 13 extends beyond the hinged point and normally abuts a leaf spring 16 and urged by the spring 16.

The leaf spring 16 is mounted to frame 14, and performs the function, for biasing the free end 13*a* of arm 13 in the direction of an arrow A to hold pressing member 11 in the closed position represented by the solid line; and for biasing the free end 13*a* of arm 13 in the direction of an arrow B to hold pressing member 11 of its open position in the same open position. In the position of retaining member 12 being closed, the side wall of frame 14 serves as the stopper for the free end 13*a* of arm 13.

A bearing portion 17 for a thumb wheel 18 coaxially rotatably mounted on retaining member 12 is formed integrally with frame 14 at the opposite end with respect to pin hinge 15 of frame 14.

The pressing member 11 and retaining member 12 are positioned so as to opposed to each other with a predetermined amount "g" of the gap therebetween.

The amount "g" is regulated according to the urging force applied by leaf spring 16 of clip C and the location of retaining member 12 which is moved by the thumb wheel 18, but is basically formed smaller than the wall thickness of tragus 6 in order to effectively press the points 7 and 8. The pressure applied by projections 19 on the points 7 and 8 is determined by the amount of "g" and the urging force of leaf spring 16, and further the fine adjustment of the pressure is performed by the displacement of retaining member 12 caused by manual rotation of thumb wheel 18.

As described above, the clip C of the embodiment is formed of the arm 13, frame 14, pin hinge 15, leaf spring 16, bearing 17 and thumb wheel 18.

The projections 19 are formed on the surface of pressing member 11 so as to be opposed to the retaining member 12, including uniformly distributed seven projections, and are so distributed that either two of these would come in the position capable of pressing the "thirst point" 7 as well as the "hunger point" 8 in the usual wearing condition.

By the arrangement above, the diet earring $R_2$ is briefly attached, by opening the pressing member 11 to the position shown by the dotted line, then closing the same to the solid lined position as engaging the pressing member 11 with the outer side of tragus 6. The fine adjustment of the pressure applied by projections of pressing member 11 is achieved by manual rotation of thumb wheel 18 in the state of wearing the earring $R_2$.

In the wearing state of earring $R_2$ onto tragus 6, the projections 19 stimulate the thirst and hunger points 7 and 8 to produce the effect for suspending the human's appetite for thirsty and hungry.

Projections 19 may be also provided for both members 11 and 12 on each surface thereof inwardly opposed to each other. In the same manner, also in the first embodiment previously described, the projections 4 may be formed on the opposed surfaces of the members 1 and 2.

Instead of ten projections 4 as in embodiment 1 or seven projections 19 as in embodiment 2, merely but at least two projections may be also formed on the pressing member, corresponding to the thirst and hunger positions, respectively.

As to the shape of the members 1 and 2, not limited in circular or elliptic shape, but any of the other shapes may be freely selected, such as rectilinear, triangular or of a star shape, especially in taking consideration of an ornamental appearance of the earring while wearing the earring onto the human tragus.

Instead of the spring urged clip C as in embodiment 2, a screwed clip may be also employed, which is, for example, formed of an arm 13 and frame 14 are integrally joined and not opened from each other.

What is claimed is:

1. A diet earring of tragus engagement type comprising:

a pressing member to be attached to an outer surface of a human tragus;

a retaining member to engage an opposite surface of said tragus;

a connecting member for connecting said pressing member and said retaining member so that said earring is retained to said tragus in the manner that said pressing member together with said retaining member hold said tragus therebetween;

a plurality of projections provided on at least one surface of either one of said pressing member and said retaining member which is opposed to each other, thereby said tragus being stimulated during the state of said tragus being retained between said pressing member and said retaining member; and wherein each of said projections is substantially circular in cross-sectional shape, said projections being spaced apart from each other by a distance corresponding to the thirst and hunger points on the tragus.

2. A diet earring according to claim 1, wherein said connecting member being one of a spring urged clip, a screw-type clip or a resilient member.

3. A diet earring according to claim 1, wherein each of said pressing member and retaining member being a plate-like member formed in a shape selected from the group consisting of an ellipse, a regular circle or a polygon.

* * * * *